US008851663B2

(12) United States Patent
Maeda

(10) Patent No.: US 8,851,663 B2
(45) Date of Patent: Oct. 7, 2014

(54) TRACTOR UNIT AND PRINTER

(75) Inventor: Hiroyuki Maeda, Matumoto (JP)

(73) Assignee: Seiko Epson Corporation, Tokyo (JP)

( * ) Notice: Subject to any disclaimer, the term of this patent is extended or adjusted under 35 U.S.C. 154(b) by 74 days.

(21) Appl. No.: 13/611,920

(22) Filed: Sep. 12, 2012

(65) Prior Publication Data

US 2013/0083147 A1 Apr. 4, 2013

(30) Foreign Application Priority Data

Sep. 30, 2011 (JP) ..... 2011-216721

(51) Int. Cl.
*B41J 2/01* (2006.01)
*B41J 11/30* (2006.01)

(52) U.S. Cl.
CPC ..... *B41J 11/30* (2013.01)
USPC ..... 347/104; 347/101

(58) Field of Classification Search
None
See application file for complete search history.

(56) References Cited

U.S. PATENT DOCUMENTS 5,456,399 A * 10/1995 Yamaguchi ..... 226/75
5,887,998 A * 3/1999 Ishikawa ..... 400/616.2

FOREIGN PATENT DOCUMENTS

JP 2002-296855 A 10/2002
TW 506342 U 10/2002

* cited by examiner

*Primary Examiner* — Geoffrey Mruk
(74) *Attorney, Agent, or Firm* — Lowe Hauptman & Ham, LLP

(57) ABSTRACT

A printer has a tractor unit with a simple configuration that can prevent the feed holes in continuous paper from disengaging the engagement pins of the tractor unit during conveyance. The tractor unit of the printer has a pair of tractors that hold the continuous paper with tractor pins (engagement pins) engaged in sprocket holes (feed holes), a drive shaft and a support shaft that support the pair of tractors, and a frame that supports the drive shaft and support shaft. The first tractor is fixed in position to the support shaft after engaging and holding one side of the continuous paper, but the support shaft is supported on the frame movably widthwise to the printer. If the continuous paper becomes skewed, the first tractor moves with the support shaft widthwise to the printer following the skew, and the sprocket holes therefore do not disengage the tractor pins.

8 Claims, 5 Drawing Sheets

TRACTOR UNIT AND PRINTER

RELATED APPLICATIONS

The present application is based on, and claims priority from, Japanese Application Number 2011-216721, filed Sep. 30, 2011, the disclosure of which is hereby incorporated by reference herein in its entirety.

BACKGROUND

1. Technical Field

The present invention relates to a tractor unit that conveys continuous paper by sequentially engaging engagement pins in feed holes formed along the length of the continuous paper and moving the engagement pins.

2. Related Art

Printers that convey continuous paper through a paper feed path past the printing position of an inkjet head or dot impact printhead, and print on the continuous paper at the printing position, are known from the literature. Such printers commonly have a tractor unit and paper feed roller as a paper conveyance mechanism for conveying the continuous paper. The tractor unit conveys continuous paper by sequentially engaging engagement pins in feed holes formed along the length of the continuous paper on both sides of the paper width and moving the engagement pins. The paper feed roller is disposed downstream in the conveyance direction from the tractor unit and driven on an axis of rotation perpendicular to the conveyance direction of the continuous paper to convey the continuous paper. Printers in which the platen roller that determines the printing position functions as the paper feed roller are also known.

A tractor unit that can be used in such printers is described in Japanese Unexamined Patent Appl. Pub. JP-A-2002-296855. The tractor unit taught in JP-A-2002-296855 has a pair of tractors that hold the continuous paper from both sides of the paper width with the engagement pins engaged in the feed holes of the continuous paper, two shafts that extend across the paper width and pass through the pair of tractors, and a clamping member that holds one of the two tractors at a specific position on the paper width.

The tractor unit described in JP-A-2002-296855 is used in a laser printer that transfers a toner image formed on a photosensitive drum to the continuous paper, and fuses the toner image on the continuous paper by applying heat and pressure. A problem with this laser printer is that the applied heat may shrink the continuous paper, causing the engagement pins to disengage the feed holes and resulting in the recording paper jamming. The tractor unit described in JP-A-2002-296855 therefore provides a gap between the clamping member and the tractor that is held by the clamping member, allowing the tractor to move on the clamping member an amount equal to the size of the gap widthwise to the paper. As a result, when the continuous paper shrinks, the one tractor slides widthwise to the paper according to the shrinkage of the paper on the clamp, the engagement pins follow the movement of the feed holes, and the feed holes are prevented from separating from the engagement pins.

Separation of the feed holes in the continuous paper from the engagement pins is not limited to when the continuous paper shrinks due to the printing method, and can also happen during normal conveyance of the continuous paper in printers with a tractor unit. The continuous paper can also become deformed and jam in the tractor unit. For example, if the conveyance direction of the continuous paper by the paper feed roller and the conveyance direction of the continuous paper by the tractor unit do not match due to the dimensional precision of the parts used in the paper feed roller and tractor unit, or the installation precision of the paper feed roller and tractor unit in the printer, for example, the conveyed continuous paper will become skewed and the force causing the continuous paper to move in a direction skewed to the conveyance direction causes the feed holes to disengage the engagement pins. If the conveyed continuous paper becomes skewed, the continuous paper will be deformed by the force causing the continuous paper to move in a direction skewed to the conveyance direction, and may jam.

The tractor unit described in JP-A-2002-296855 could conceivably be used to prevent the feed holes from separating from the engagement pins due to the installation precision of the paper feed roller and tractor unit, for example, but the construction of the tractor unit taught in JP-A-2002-296855 is complicated by the the need to use a clamping member that supports the tractor movably transversely to the paper.

SUMMARY

To solve the foregoing problem, a tractor unit with a simple configuration according to the present invention prevents the feed holes in continuous paper from disengaging the engagement pins during conveyance. A printer according to the invention uses the tractor unit.

One aspect of the invention is a tractor unit that conveys continuous paper by sequentially engaging engagement pins in feed holes formed along the length of both sides of the width of continuous paper and moving the engagement pins, the tractor unit including: a first tractor and a second tractor that each have an endless belt having a plurality of engagement pins formed on the outside circumference surface, and a drive pulley and follower pulley on which the endless belt is mounted, and hold the continuous paper on opposite sides of the paper width with the engagement pins engaged in the feed holes; a drive shaft that extends perpendicularly to the conveyance direction of the continuous paper, supports the first tractor and second tractor movably perpendicularly to the conveyance direction, and rotationally drives the drive pulley; a support shaft that is disposed parallel to the drive shaft in the conveyance direction, supports the first tractor and second tractor movably perpendicularly to the conveyance direction, and rotatably supports the follower pulley; a clamping mechanism that holds the first tractor in a fixed position on the support shaft; and a frame that supports the drive shaft and the support shaft, and supports the support shaft movably perpendicularly to the conveyance direction.

The first tractor and second tractor in this aspect of the invention are supported by the drive shaft and support shaft movably in a direction perpendicular to the conveyance direction of the continuous paper. When the continuous paper is set into the tractor unit, the first tractor is fixed in position to the support shaft by the clamping mechanism after the engagement pins are engaged in the feed holes and hold one side of the continuous paper, and can move with the support shaft in the direction perpendicular to the conveyance direction because the support shaft is supported by the frame so that the support shaft can move perpendicularly to the conveyance direction. As a result, if the continuous paper becomes skewed while the continuous paper is being conveyed, the first tractor can follow the skewing of the continuous paper and move with the support shaft perpendicularly to the conveyance direction of the continuous paper due to the force causing the continuous paper to move perpendicularly to the conveyance direction. Separation of the feed holes from the engagement pins can therefore be prevented or suppressed because the engagement pins follow movement of the feed holes.

In addition, because the first tractor moves perpendicularly to the conveyance direction following skewing of the continuous paper, deformation of the continuous paper can be suppressed and jamming of the continuous paper can be prevented or suppressed.

Yet further, because the invention enables the first tractor to move following skewing of the continuous paper by simply supporting the support shaft movably in the axial direction on the frame, a support member that holds the first tractor movably in the direction perpendicular to the conveyance direction of the continuous paper is not needed, and the tractor unit can be rendered with a simple configuration.

Preferably, the second tractor cannot be held in a fixed position on the support shaft.

This enables the second tractor to move in the axial direction independently of movement of the support shaft. As a result, if the continuous paper becomes skewed during conveyance, the second tractor moves perpendicularly to the conveyance direction following skewing of the continuous paper independently of the first tractor. More specifically, because the engagement pins on the second tractor side also follow movement of the feed holes in the continuous paper, separation of the feed holes from the engagement pins can be prevented. In addition, because the second tractor moves perpendicularly to the conveyance direction following skewing of the continuous paper, deformation of the continuous paper can be better suppressed and the continuous paper can be prevented from jamming.

Further preferably, the second tractor is supported pivotably in the plane containing the axis of the drive shaft and the axis of the support shaft.

This configuration enables the second tractor to incline in a direction perpendicular to the conveyance direction following the skew of the continuous paper when the continuous paper becomes skewed during conveyance. Separation of the feed holes in the continuous paper from the engagement pins can therefore be reliably prevented. Furthermore, because the second tractor inclines with the skew of the continuous paper, deformation of the continuous paper can be suppressed even more, and the continuous paper can be prevented from becoming jammed.

In order to enable the second tractor to pivot in this case, the second tractor preferably has a bearing that holds the drive shaft, and a bearing hole through which the support shaft passes; the bearing can rotate on an axis of rotation extending perpendicularly to the conveyance direction and the axis of the drive shaft; and the bearing hole is an oval with the long axis extending in the conveyance direction, enabling the second tractor to move in the conveyance direction relative to the support shaft.

Further preferably, to prevent the second tractor from moving more than needed to following skewing of the continuous paper, the tractor unit preferably has a stop that contacts the second tractor and limits the range of second tractor movement when the second tractor moves perpendicularly to the conveyance direction.

The tractor unit in this aspect of the invention could also have a second clamping member that holds the second tractor in a fixed position on the support shaft.

More specifically, when the continuous paper is set in the tractor unit, the second tractor can be held in a fixed position on the support shaft by the clamping member after the engagement pins are engaged with the feed holes and the second tractor holds the other side of the continuous paper. This enables the second tractor to move with the first tractor and support shaft in the direction perpendicular to the continuous paper conveyance direction while keeping the distance between the second tractor and first tractor appropriate to the width of the continuous paper. As a result, if the continuous paper becomes skewed during conveyance, the second tractor moves perpendicularly to the conveyance direction following skewing of the continuous paper while maintaining a constant distance to the first tractor. Because the engagement pins can follow movement of the feed holes, separation of the feed holes from the engagement pins can be prevented.

In addition, because the gap between the first tractor and second tractor is maintained when the pair of tractors move perpendicularly to the conveyance direction following skewing of the continuous paper, deformation of the continuous paper can be suppressed, and the continuous paper can be prevented from becoming jammed.

Further preferably, the support shaft is supported with an end part thereof passing through a bearing hole formed in the frame, and has disposed to the end part thereof a stop that contacts the frame and limits the range of support shaft movement when the support shaft moves perpendicularly to the conveyance direction.

Because the range of support shaft movement can be limited, this aspect of the invention can also limit the range of movement of the tractor held stationary on the support shaft. The tractor fixed on the support shaft can therefore be prevented from moving more than needed to follow skewing of the continuous paper.

Another aspect of the invention is a printer having a paper conveyance mechanism that conveys continuous paper through a paper conveyance path past the printing position of a printhead, wherein the paper conveyance mechanism has a tractor unit described above that feeds the continuous paper toward the printing position; and a paper feed roller that is disposed downstream in the conveyance direction of the continuous paper from the tractor unit, and is rotationally driven on an axis of rotation perpendicular to the conveyance direction.

This aspect of the invention can prevent the feed holes of the continuous paper from separating from the engagement pins in the tractor unit even if the conveyance direction of the continuous paper by the paper feed roller and the conveyance direction of the continuous paper by the tractor unit deviate from each other due to the dimensional precision of the parts in the paper feed roller and tractor unit or the installation precision of the paper feed roller and tractor unit in the printer, and the conveyed continuous paper becomes skewed. The continuous paper can also be prevented from becoming jammed in the tractor unit.

Effect of the Invention

If the continuous paper becomes skewed while being conveyed, the invention enables at least the first tractor to follow skewing of the continuous paper and move together with the support shaft in a direction perpendicular to the conveyance direction of the continuous paper. Because the engagement pins therefore follow movement of the feed holes, separation of the feed holes from the engagement pins and deformation of the continuous paper can be prevented. In addition, because the first tractor can be moved following skewing of the continuous paper by means of a simple configuration that supports the support shaft to which the first tractor is fixed movably in the axial direction, the tractor unit can also be rendered with a simple configuration.

DESCRIPTION OF EMBODIMENTS

A printer according to the invention is described below with reference to the accompanying figures.

General Configuration

Figure 1:
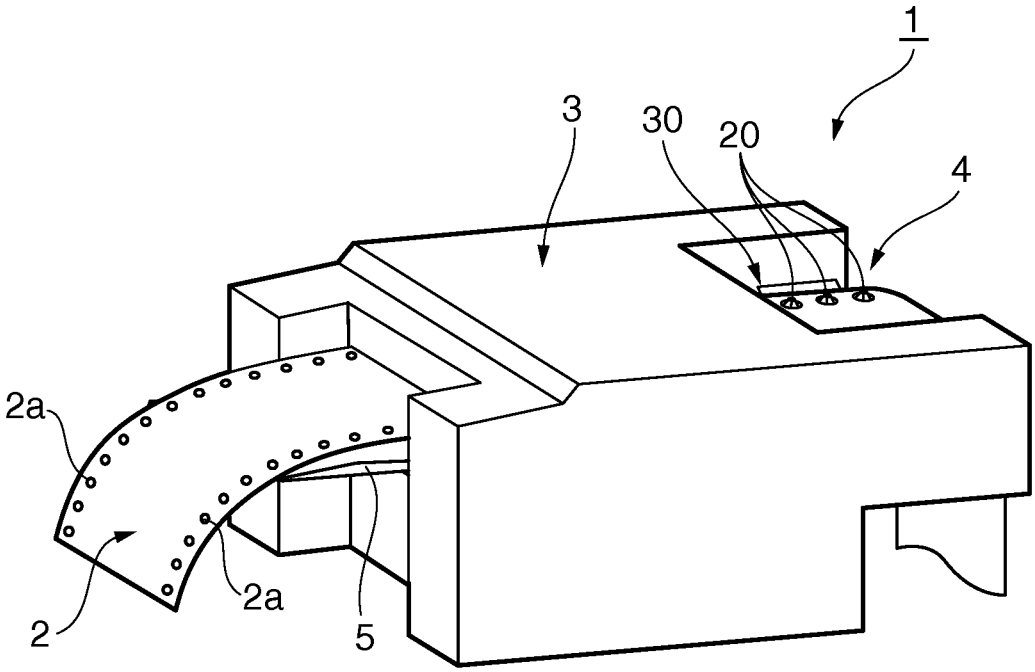
FIG. 1 is an oblique view of a printer according to a preferred embodiment of the invention.

FIG. 1 is an oblique view of a printer according to the invention. The printer 1 prints on continuous paper 2 having sprocket holes 2*a* (feed holes) formed along the length of both sides of the paper width. The printer 1 has a printer case 3, a tractor unit 4 installed at the back of the printer case 3 in the front-back (longitudinal) direction of the printer, and a discharge tray 5 attached at the front of the printer case 3. The continuous paper 2 is fed into the printer case 3 from the back of the printer by the tractor unit 4, and after printing is discharged from the printer case 3 along the discharge tray 5.

Figure 2:
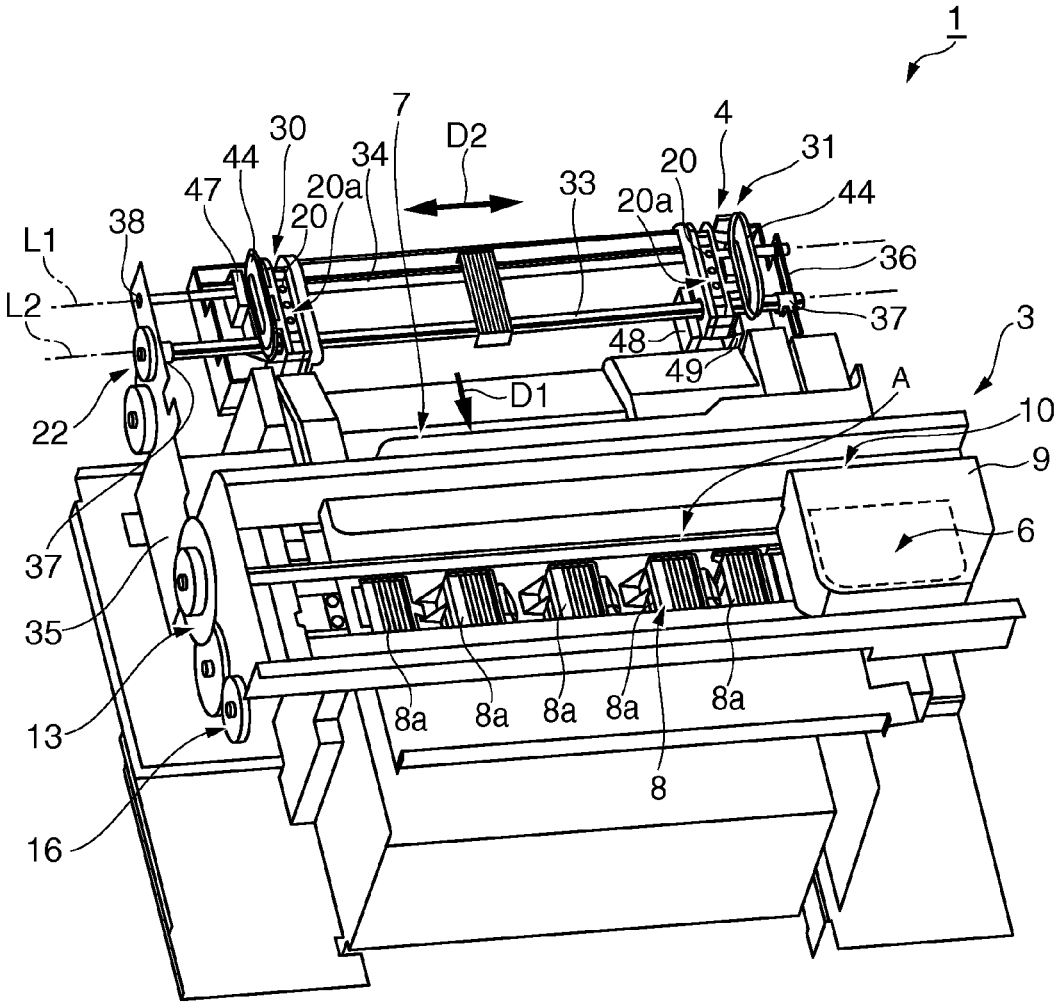
FIG. 2 is an oblique view from diagonally above the printer with the case removed.
Figure 3A:
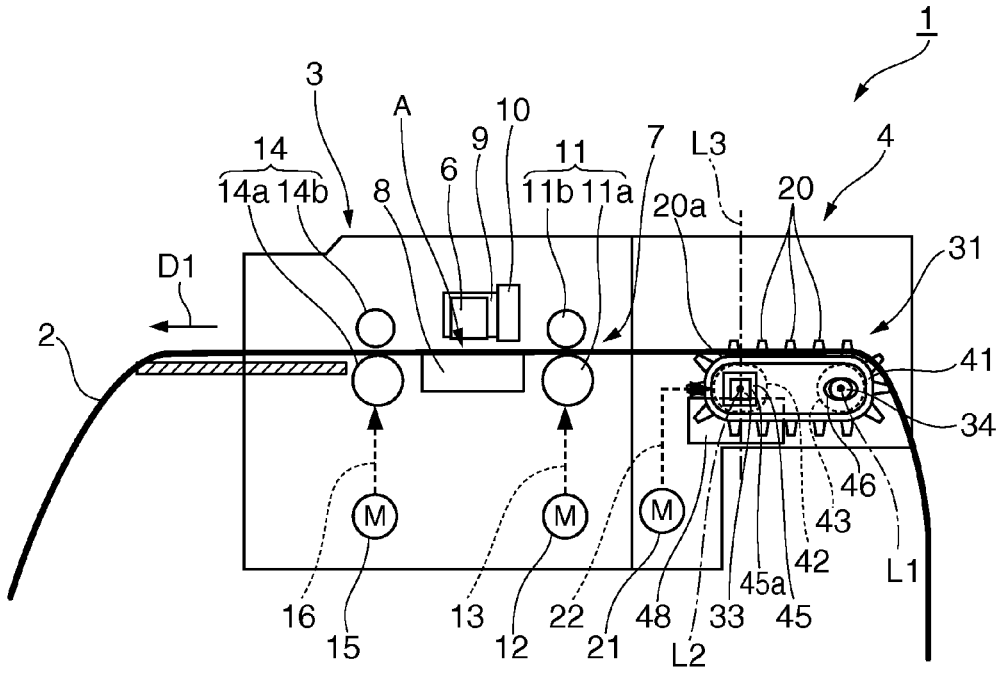
FIG. 3A is a section view showing main parts of the printer.

FIG. 2 is an oblique view from diagonally above the printer 1 with the outside case and the discharge tray 5 removed. FIG. 3A is a section view showing main parts of the printer 1, and FIG. 3B is a plan view of the paper conveyance path.

Figure 3B:
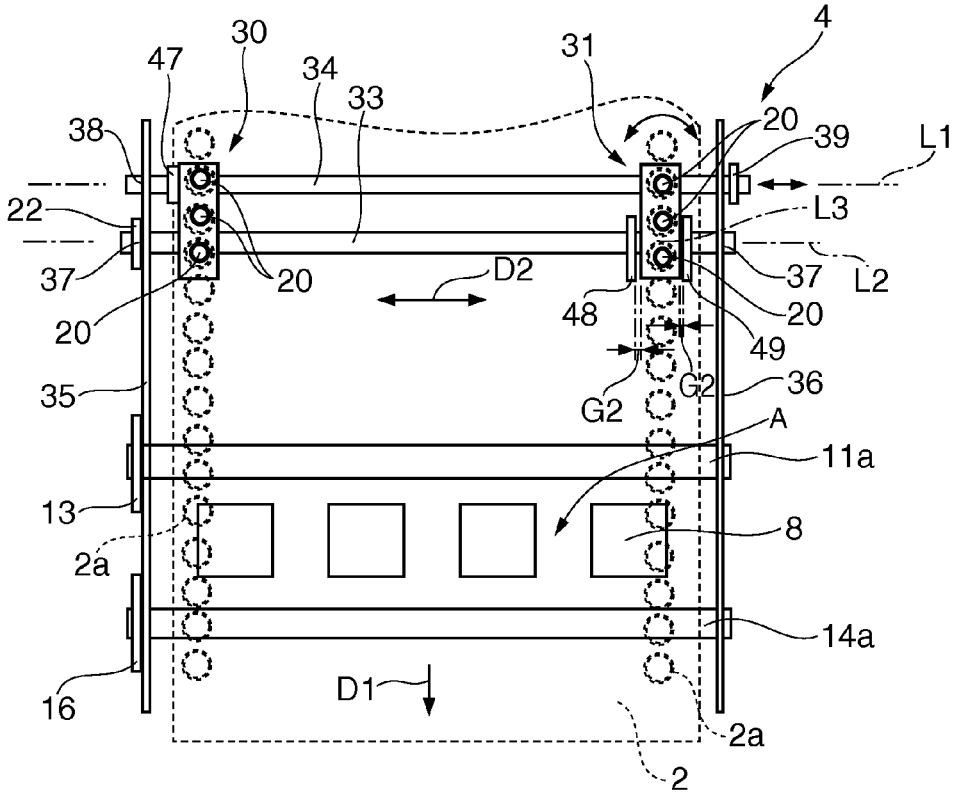
FIG. 3B is a plan view of the paper conveyance path.

As shown in FIG. 2 and FIG. 3A and FIG. 3B, a conveyance path 7 for conveying the continuous paper 2 past the printing position A of the printhead 6 is formed inside the printer 1. The printing position A is determined by a platen 8 disposed below the conveyance path 7, and the conveyance path 7 extends straight between the front and back of the printer from the tractor unit 4 past the platen 8 to the discharge tray 5. The platen 8 in this embodiment has a plurality of platen sections 8*a* arrayed with a specific gap therebetween across the device width direction D2 perpendicular to the conveyance direction D1 of the continuous paper 2 conveyed through the paper conveyance path.

The printhead 6 is an inkjet head and is mounted on a carriage 9 with the ink nozzle face facing down. The carriage 9 is moved bidirectionally in the device width direction D2 by a carriage moving mechanism 10.

As shown in FIG. 3, a paper feed roller pair 11 for supplying the continuous paper 2 to the printing position A is disposed between the printing position A and the tractor unit 4. The paper feed roller pair 11 includes a paper feed roller 11*a* disposed below and a pressure roller 11*b* disposed above the conveyance path 7. As shown by the dotted line in FIG. 3A, drive power from a paper feed motor 12 is transmitted to the paper feed roller 11*a* through a first drive power transmission mechanism 13, which is a gear train. The pressure roller 11*b* is urged toward the paper feed roller 11*a* to press the continuous paper 2 against the paper feed roller 11*a*.

A discharge roller pair 14 for discharging the printed continuous paper 2 is disposed toward the front of the printer (downstream in the conveyance direction D1) from the printing position A. the discharge roller pair 14 includes a discharge roller 14*a* disposed below and a pressure roller 14*b* disposed above the conveyance path 7. As shown by the dotted line in FIG. 3A, drive power from a discharge motor 15 is transmitted to the discharge roller 14*a* through a second drive power transmission mechanism 16, which is a gear train. The pressure roller 14*b* is urged toward the discharge roller 14*a* to press the continuous paper 2 against the discharge roller 14*a*.

The tractor unit 4 conveys the continuous paper 2 toward the printing position A by sequentially engaging tractor pins (engagement pins) 20 that can move along a circular path 20*a* in the sprocket holes 2*a* formed along both edges of the width of the continuous paper 2, and moving the tractor pins 20. Drive power from a tractor drive motor 21 is transmitted to the tractor unit 4 through a third drive power transmission mechanism 22, which is a gear train.

When the continuous paper 2 is set in the tractor unit 4 and a print command is supplied to the printer 1 from an external device, the tractor unit 4 is driven and the continuous paper 2 is conveyed along the conveyance path 7 to the printing position A. The paper feed roller 11*a* and discharge roller 14*a* are also driven, and the continuous paper 2 is nipped by the paper feed roller pair 11 and discharge roller pair 14. As a result, when the desired position on the continuous paper 2 for starting printing is set to the printing position A, the printer 1 prints on the continuous paper 2 as it passes the printing position A by alternately repeating an ink ejection operation, which ejects ink from the printhead 6 while the printhead 6 moves in the device width direction D2 by moving the carriage 9 with the carriage moving mechanism 10, and a paper conveyance operation, which drives the tractor unit 4, paper feed roller 11*a*, and discharge roller 14*a* to feed the continuous paper 2 toward the front of the printer.

The conveyance power that feeds the continuous paper 2 forward to the front of the printer 1 increases sequentially from the discharge roller 14*a* to the paper feed roller 11*a* and tractor unit 4. The conveyance speed of the paper feed roller 11*a* is also greater than the conveyance speed of the continuous paper 2 by the discharge roller 14*a* and tractor unit 4. This configuration enables keeping tension applied to the continuous paper 2 while conveying the continuous paper 2 through the conveyance path 7.

Tractor Unit

The tractor unit 4 is described in detail next.

Figure 4:
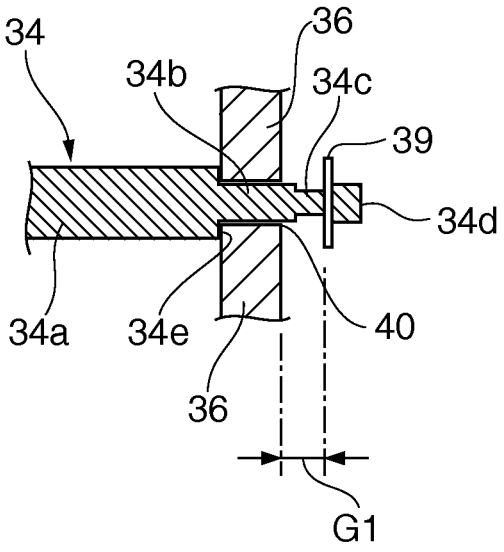
FIG. 4 is a section view of the end part of the support shaft and a second frame that supports this end part.

FIG. 4 is a section view of the end part of a support shaft 34 and a second frame 36 that supports the end of the support shaft 34. As shown in FIG. 2 and FIG. 3B, the tractor unit 4 includes a pair of tractors, first tractor 30 and second tractor 31; a drive shaft 33 and support shaft 34; and a pair of support frames, first frame 35 and second frame 36.

The first tractor 30 and second tractor 31 hold the continuous paper 2 at opposite sides of the paper width with tractor pins 20 engaged in the sprocket holes 2*a* of the continuous paper 2. The drive shaft 33 and support shaft 34 extend parallel to the device width direction D2, and support the first tractor 30 and second tractor 31. The first frame 35 and second frame 36 support the drive shaft 33 and support shaft 34.

The drive shaft 33 is positioned toward the front of the printer from the support shaft 34, and is supported at the ends to rotate freely by bearings 37 attached to the first frame 35 and second frame 36. The drive shaft 33 is rectangular in section, and is driven rotationally by drive power from a tractor drive motor 21.

The support shaft 34 is round in section, and is supported movably in the device width direction D2 by the first frame 35 and second frame 36. More specifically, the end of the support shaft 34 on the left side of the printer is supported in a first bearing hole 38, which is a channel or through-hole formed in the first frame 35. As shown in FIG. 4, the support shaft 34 has a support part 34*a* that supports the pair of tractors 30, 31, and in order from the support part 34*a* to the end of the support shaft 34 on the right side of the printer has a first small diameter part 34*b*, a second small diameter part 34*c*, and a shaft end part 34*d*. The first small diameter part 34*b* has a smaller outside diameter than the outside diameter of the support part 34*a*, and a length greater than the thickness of the second frame 36 along the axis L1 of the support shaft 34. The second small diameter part 34*c* has a smaller outside diameter than the first small diameter part 34*b*. The shaft end part 34*d* has the same outside diameter as the first small diameter part 34*b*.

An annular groove (not shown in the figure) is formed in the second small diameter part 34*c* at a position beside the shaft end part 34*d*, and a retaining ring (stop) 39 with a larger outside diameter than the first small diameter part 34*b* is fit into this groove.

A second bearing hole 40 formed in the second frame 36 has an inside diameter that is slightly greater than the outside diameter of the first small diameter part 34*b*, and smaller than the outside diameter of the support part 34*a* and retaining ring 39, and the support shaft 34 is supported with the first small diameter part 34*b* inserted in this second bearing hole 40. When the end of the support shaft 34 on the right side is inserted to the second bearing hole 40, and the round end face (stop) 34*e* on the first small diameter part 34*b* side of the support part 34*a* is in contact with the inside surface of the second frame 36, part of the first small diameter part 34*b* is exposed outside the second frame 36, and a gap G1 that is less than the thickness of the first frame 35 is formed between the second frame 36 and the retaining ring 39. The support shaft 34 can therefore move the size of the gap G1 in the device width direction D2 until the retaining ring 39 contacts the second frame 36.

As shown in FIG. 3A, the first tractor 30 and second tractor 31 each have an endless belt 41 on the outside of which tractor pins 20 are formed at a specific interval, and a drive pulley 42 and follower pulley 43 on which the endless belt 41 is mounted. The drive pulley 42 is positioned closer to the front of the printer than the follower pulley 43. The first tractor 30 and second tractor 31 each also have a tractor cover 44 that, after the continuous paper 2 is set with the sprocket holes 2*a* on the tractor pins 20, partially covers the held portion from above. The outside diameter of the tractor pins 20 is smaller than the inside diameter of the sprocket holes 2*a* of the continuous paper 2. As a result, a slight amount of movement is possible between the continuous paper 2 and the pair of tractors 30, 31 when the sprocket holes 2*a* are engaged by the tractor pins 20. Note that the tractor cover 44 is shown in FIG. 2 but not in the other figures.

A drive-side bearing 45 with a rectangular through-hole 45*a* in the printer width direction is disposed in the center of the drive pulley 42. The drive shaft 33 is inserted to the through-hole 45*a* of the drive-side bearing 45, and the first tractor 30 and second tractor 31 are supported by the drive shaft 33 movably along the axis L2 of the drive shaft 33.

A follower-side bearing hole 46 passes through the center of the follower pulley 43 in the printer width direction. The support shaft 34 is inserted to the follower-side bearing hole 46, and the first tractor 30 and second tractor 31 are supported by the support shaft 34 movably along the axis L1 of the support shaft 34.

When the drive shaft 33 is driven rotationally, drive power is transferred from the drive shaft 33 to the drive pulley 42, the drive pulley 42 is thus driven rotationally, and the endless belt 41 and follower pulley 43 rotate therewith. As a result, the tractor pins 20 move along the circular path 20*a* defined by the endless belt 41.

The first tractor 30 on the left side of the device width direction D2 has a clamping mechanism 47 that clamps the first tractor 30 to the support shaft 34. A common clamping mechanism 47 holds the first tractor 30 at a specific position on the support shaft 34 by using a lever mechanism to push a plastic part of the follower-side bearing hole 46 in the first tractor 30 against the support shaft 34. When the first tractor 30 is fastened to the support shaft 34 by the clamping mechanism 47, the first tractor 30 is perpendicular to the axis L2 of the drive shaft 33 and the axis L1 of the support shaft 34.

The second tractor 31 located at the other side of the device width direction D2 does not have a clamping mechanism for clamping the second tractor 31 to the support shaft 34, and cannot be fixed to the support shaft 34.

As shown in FIG. 3A, the drive-side bearing 45 in the center of the drive pulley 42 of the second tractor 31 can rotate on an axis of rotation L3 extending vertically perpendicular to the axis L2 of the drive shaft 33. In other words, the drive-side bearing 45 is supported by the second tractor 31 with a slight degree of freedom around the axis of rotation L3.

In addition, the follower-side bearing hole 46 is an oval that is long in the front-back direction of the printer when seen in line with the axis L1 of the support shaft 34, and thus allows the support shaft 34 to move relative to the follower-side bearing hole 46 in the front-back direction.

The second tractor 31 is thus supported by the drive shaft 33 and support shaft 34 so that it can move relative to the axis L2 of the drive shaft 33 and the axis L1 of the support shaft 34, and can pivot in the plane containing the axis L2 of the drive shaft 33 and the axis L1 of the support shaft 34.

The tractor unit 4 has an inside stop 48 and an outside stop 49 that contact the second tractor 31 and limit the range of second tractor 31 movement when the second tractor 31 moves on the axis L2 of the drive shaft 33. The inside stop 48 is on the first tractor 30 side of the second tractor 31, and the outside stop 49 is on the second frame 36 side of the second tractor 31. The gap between the inside stop 48 and outside stop 49 in the device width direction D2 is greater than the width of the second tractor 31, and there is a gap G2 between the inside stop 48 and outside stop 49 and the second tractor 31 as shown in FIG. 3B.

Setting the Continuous Paper on the Tractors

To set the continuous paper 2 on the tractor unit 4, the sprocket holes 2*a* formed on the right side of the continuous paper 2 are first fit onto the tractor pins 20 of the second tractor 31, and the part of the continuous paper 2 held by the second tractor 31 is partially covered by the tractor cover 44. The second tractor 31 thus holds the right side of the continuous paper 2.

The first tractor 30 is then slid along the drive shaft 33 and support shaft 34 to the position where the sprocket holes 2*a* formed along the left side of the continuous paper 2 and the tractor pins 20 on the first tractor 30 can engage. The sprocket holes 2*a* are then fit onto the tractor pins 20 of the first tractor 30, and the first tractor 30 is pulled in the direction of the continuous paper 2 width away from the second tractor 31 to remove slack from the continuous paper 2. The first tractor 30 is then clamped to the support shaft 34 using the clamping mechanism 47. The part of the continuous paper 2 held by the first tractor 30 is then partially covered with the tractor cover 44. The first tractor 30 thus holds the left side of the continuous paper 2.

If the first tractor 30 is pulled away from the second tractor 31 with the sprocket holes 2*a* engaged with the tractor pins 20 of the first tractor 30 after the right side of the continuous paper 2 is held by the second tractor 31 when the continuous paper 2 is set in the tractor unit 4, the second tractor 31 will move to the first tractor 30 side and stop in contact with the inside stop 48. Slack in the continuous paper 2 can therefore be removed even though the second tractor 31 can move along the axis L1 of the drive shaft 33 and support shaft 34. The first tractor 30 and second tractor 31 are also positioned in the device width direction D2 when the continuous paper 2 is set.

When the tractor drive motor 21 is driven with the continuous paper 2 loaded in the tractor unit 4, the drive shaft 33 turns, the endless belt 41 turns, and the tractor pins 20 moves along the circular path 20*a*. As a result, the tractor pins 20 move while sequentially engaging the sprocket holes 2*a* of the continuous paper 2, and the continuous paper 2 is conveyed toward the printing position A.

Operation of the Tractor Unit While Conveying Continuous Paper

Because the conveyed continuous paper 2 will become skewed in a printer 1 having a tractor unit 4, such as the printer 1 according to this embodiment of the invention, if the conveyance direction D1 of the paper feed roller 11*a* and the conveyance direction D1 of the tractor unit 4 differ due to the dimensional precision of the parts in the paper feed roller 11*a* and tractor unit 4 or the installation precision of the paper feed roller 11*a* and tractor unit 4 to the printer 1, the force causing the continuous paper 2 to move in a direction skewed to the conveyance direction D1 may cause the sprocket holes 2*a* to separate from the tractor pins 20. If the conveyed continuous paper 2 becomes skewed, the continuous paper 2 will be deformed by the force causing the continuous paper 2 to move in a direction skewed to the conveyance direction D1, and may jam.

To solve this problem, the first tractor 30 and second tractor 31 of the tractor unit 4 according to this embodiment of the invention move according to skewing of the continuous paper 2.

Figure 5A:
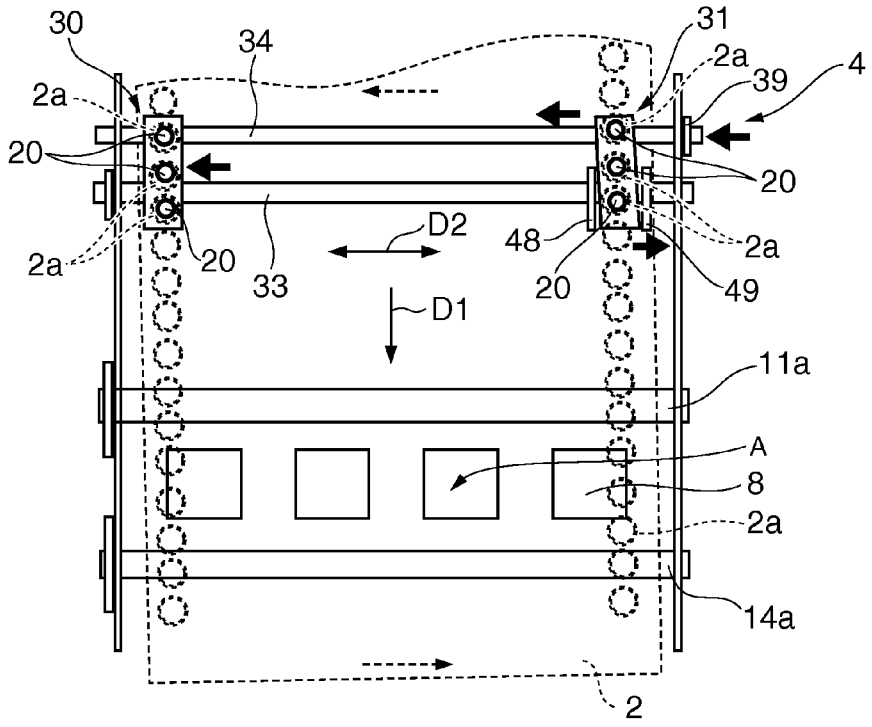
FIG. 5 describes the tractor following skew in the continuous paper.

For example, when the continuous paper 2 becomes skewed such that the downstream side of the continuous paper 2 in the conveyance direction moves to the right side of the printer and the upstream side moves to the left side as shown in FIG. 5A, the force causing the continuous paper 2 to move in the direction skewed to the conveyance direction D1 causes the first tractor 30 to follow the skewing of the continuous paper 2 and move together with the support shaft 34 to the left in the device width direction D2. The force moving the continuous paper 2 in the direction skewed to the conveyance direction D1 also causes the second tractor 31 to following the continuous paper 2 skew and become skewed in the same direction as the continuous paper 2. Because the tractor pins 20 of the first tractor 30 and the tractor pins 20 of the second tractor 31 thus follow the movement of the sprocket holes 2*a*, separation of the sprocket holes 2*a* from the tractor pins 20 is prevented or suppressed. In addition, because the pair of tractors 30, 31 holding the sides of the continuous paper 2 follow the skew of the continuous paper 2, deformation of the continuous paper 2 can be suppressed, and jamming of the continuous paper 2 can be prevented or suppressed.

Figure 5B:
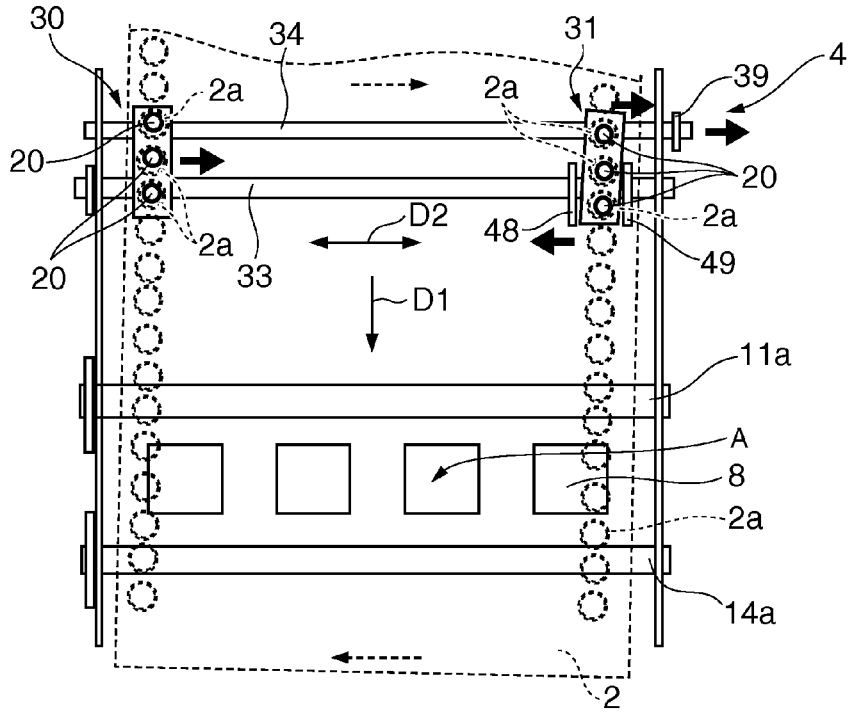

In addition, when the downstream end of the continuous paper 2 in the conveyance direction moves to the left side of the printer and the upstream end moves to the right side as shown in FIG. 5B, the force skewing the continuous paper 2 to the conveyance direction D1 also causes the first tractor 30 to follow the skewing of the continuous paper 2 and move with the support shaft 34 to the right in the device width direction D2. The second tractor 31 also follows the skewing of the continuous paper 2 and becomes skewed in the same direction as the continuous paper 2. As a result, because the tractor pins 20 of the first tractor 30 and the tractor pins 20 of the second tractor 31 follow the movement of the sprocket holes 2*a*, separation of the sprocket holes 2*a* from the tractor pins 20 can be prevented or suppressed. In addition, because the tractors holding the sides of the continuous paper 2 follow the skew of the continuous paper 2, deformation of the continuous paper 2 can be suppressed, and jamming of the continuous paper 2 can be prevented or suppressed.

This embodiment of the invention thus enables the first tractor 30 to follow skewing of the continuous paper 2 by the pair of frames 35 and 36 simply supporting the support shaft 34 movably along its axis L1. The configuration of the tractor unit 4 can thus be simplified.

Furthermore, by having an inside stop 48 and an outside stop 49 that contact the second tractor 31 and limit the range of second tractor 31 movement when the second tractor 31 moves in the device width direction D2, this embodiment of the invention can prevent the second tractor 31 from moving more than required to follow skewing of the continuous paper 2.

Yet further, because movement of the support shaft 34 supported by the pair of frames 35 and 36 is limited by the round end face 34*e* and retaining ring 39 disposed to the right side end of the support shaft 34, this embodiment can also prevent the first tractor 30 fixed to the support shaft 34 from moving more than required to follow skewing of the continuous paper 2.

Other Embodiments

The second tractor 31 in the foregoing embodiment can move along the axis L2 of the drive shaft 33 and the axis L1 of the support shaft 34, and is supported by the drive shaft 33 and support shaft 34 pivotably in the plane containing the axis L2 of the drive shaft 33 and the axis L1 of the support shaft 34, but if the second tractor 31 can move at least along the axis L2 of the drive shaft 33 and the axis L1 of the support shaft 34, the second tractor 31 can follow the continuous paper 2 when the continuous paper 2 becomes skewed while being conveyed. Separation of the sprocket holes 2*a* from the tractor pins 20 can therefore be prevented or suppressed. Deformation of the continuous paper 2 can also be suppressed, and jamming of the continuous paper 2 can be prevented or suppressed.

A second clamping mechanism that fixes the second tractor 31 on the support shaft 34 could also be provided in the embodiment described above. More specifically, when the continuous paper 2 is set in the tractor unit 4, the second tractor 31 can be fixed in position on the support shaft 34 by the second clamping mechanism after the sprocket holes 2*a* are set on the tractor pins 20 and the second tractor 31 holds the other side of the continuous paper 2.

In this case, the second tractor 31 moves with the first tractor 30 and the support shaft 34 in the device width direction D2 while holding the distance between the second tractor 31 and the first tractor 30 to the width of the continuous paper 2. As a result, when the continuous paper 2 becomes skewed during conveyance, the second tractor 31 moves in the device width direction D2 following skewing of the continuous paper 2 while maintaining the same distance to the first tractor 30. Separation of the sprocket holes 2*a* from the tractor pins 20 can therefore be prevented because the tractor pins 20 follow the sprocket holes 2*a*. Deformation of the continuous paper 2 can also be suppressed, and jamming of the continuous paper 2 can be prevented, because the distance between the first tractor 30 and second tractor 31 remains the same when the pair of tractors 30, 31 move in the device width direction D2 following skewing of the continuous paper 2.

Note that when the second tractor is fixed on the support shaft 34, the inside stop 48 and outside stop 49 that limit movement of the second tractor 31 can be omitted. Alternatively, the inside stop 48 and outside stop 49 could be provided while omitting the configuration limiting movement of the support shaft 34 disposed at the second frame 36 and the right side end of the support shaft 34. By limiting movement of the second tractor 31 with the inside stop 48 and outside stop 49 in this case, movement of the support shaft 34 in the device width direction D2 can be limited.

The configuration that limits movement of the support shaft 34 in the embodiment described above is disposed to the second frame 36 and the right side end of the support shaft 34 supported by the second frame 36, but could alternatively be disposed to the first frame 35 and the left side end of the support shaft 34 supported by the first frame 35.

The configuration that limits movement of the support shaft 34 is also not limited to that described above. For example, movement of the support shaft 34 could be limited by passing the ends of the support shaft 34 movably in the axial direction through the first bearing hole 38 disposed in the first frame 35 and the bearing hole in the second frame 36, and attaching a first member that can contact the first frame 35 and a second member that can contact the second frame 36 when the support shaft 34 moves in the device width direction D2 to opposite axial ends of the support shaft 34.

The printhead 6 in the foregoing embodiment is an inkjet head, but the invention can also be applied to a printer 1 in which the printhead 6 is a dot impact head that prints by striking an ink ribbon with recording wires and transferring ink from the ink ribbon to the continuous paper 2. In this case, the platen 8 is preferably a single platen that extends across the conveyance path 7 in the device width direction D2 instead of having a plurality of platen sections 8*a*.

Yet further, the tractor unit 4, paper feed roller 11*a*, and discharge roller 14*a* are driven separately by a tractor drive motor 21, paper feed motor 12, and discharge motor 15 in the embodiment described above, but drive power could be transferred through a drive power transmission mechanism from a common drive source of one or two drive motors to the the tractor unit 4, paper feed roller 11*a*, and discharge roller 14*a*.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A tractor unit that conveys continuous paper by sequentially engaging engagement pins in feed holes formed along the length of both sides of the width of continuous paper and moving the engagement pins, comprising:

a first tractor and a second tractor that each have an endless belt having a plurality of engagement pins formed on the outside circumference surface, and a drive pulley and follower pulley on which the endless belt is mounted, and hold the continuous paper on opposite sides of the paper width with the engagement pins engaged in the feed holes;

a drive shaft that extends perpendicularly to the conveyance direction of the continuous paper, supports the first tractor and second tractor movably perpendicularly to the conveyance direction, and rotationally drives the drive pulley;

a support shaft that is disposed parallel to the drive shaft in the conveyance direction, supports the first tractor and second tractor movably perpendicularly to the conveyance direction, and rotatably supports the follower pulley;

a clamping mechanism that holds the first tractor in a fixed position on the support shaft; and a frame that supports the drive shaft and the support shaft, and supports the support shaft movably perpendicularly to the conveyance direction.

2. The tractor unit described in claim 1, wherein:

the second tractor cannot be held in a fixed position on the support shaft.

3. The tractor unit described in claim 2, further comprising:

a stop that contacts the second tractor and limits the range of second tractor movement when the second tractor moves perpendicularly to the conveyance direction.

4. The tractor unit described in claim 1, wherein:

the second tractor is supported pivotably in the plane containing the axis of the drive shaft and the axis of the support shaft.

5. The tractor unit described in claim 4, wherein:

the second tractor has a bearing that holds the drive shaft, and a bearing hole through which the support shaft passes;

the bearing can rotate on an axis of rotation extending perpendicularly to the conveyance direction and the axis of the drive shaft; and the bearing hole is an oval with the long axis extending in the conveyance direction, enabling the second tractor to move in the conveyance direction relative to the support shaft.

6. The tractor unit described in claim 1, further comprising:

a second clamping member that holds the second tractor in a fixed position on the support shaft.

7. The tractor unit described in claim 1, wherein:

the support shaft is supported with an end part thereof passing through a bearing hole formed in the frame, and has disposed to the end part thereof a stop that contacts the frame and limits the range of support shaft movement when the support shaft moves perpendicularly to the conveyance direction.

8. A printer having a paper conveyance mechanism that conveys continuous paper through a paper conveyance path past the printing position of a printhead, wherein the paper conveyance mechanism comprises:

a tractor unit described in claim 1 that feeds the continuous paper toward the printing position; and a paper feed roller that is disposed downstream in the continuous paper conveyance direction from the tractor unit, and is rotationally driven on an axis of rotation extending perpendicularly to the conveyance direction;

wherein the paper feed roller is positioned between the tractor unit and the printing position.

* * * * *